United States Patent [19]

Peters et al.

[11] Patent Number: 4,675,541

[45] Date of Patent: Jun. 23, 1987

[54] AUTOMATIC FIRE PREVENTION SYSTEM

[76] Inventors: Henry T. Peters, 22484 Maple, St. Clair Shores, Mich. 48081; Harry Kalayjian, 620 Commerce Rd., Union Lake, Mich. 48085

[21] Appl. No.: 827,460

[22] Filed: Feb. 7, 1986

[51] Int. Cl.[4] ..... A62C 35/04

[52] U.S. Cl. ..... 307/117; 169/65; 340/577; 137/624.12

[58] Field of Search ..... 307/117; 340/577, 578, 340/579, 287, 286 R, 288, 289, 290, 291, 292, 293, 297, 309.15; 169/5, 7, 11, 12, 13, 16, 54, 56, 51, 60, 61, 65, 69, 70; 137/624.11, 624.12; 239/66, 67, 69, 70, 71, 72; 116/101, 103, 207; 337/298; 361/154

[56] References Cited

U.S. PATENT DOCUMENTS

| | | | |
|---|---|---|---|
| 1,308,684 | 7/1919 | Ruchty . | |
| 2,325,189 | 7/1943 | McCollum | 137/161 |
| 3,227,219 | 1/1966 | Boyer et al. | 169/23 |
| 3,250,294 | 5/1966 | Hipple | 137/528 |
| 3,653,443 | 4/1972 | Dockery | 169/65 X |
| 3,866,687 | 2/1975 | Banner | 169/65 X |
| 4,082,113 | 4/1978 | O'Neil | 137/624.11 |
| 4,141,007 | 2/1979 | Kavasilios et al. | 340/287 X |
| 4,143,812 | 3/1979 | Fortune | 236/48 R |
| 4,262,286 | 4/1981 | Tanigawa | 340/577 X |
| 4,262,687 | 4/1981 | Kobayashi | 137/624.12 X |
| 4,263,928 | 4/1981 | Kobayashi et al. | 137/624.12 X |
| 4,356,870 | 11/1982 | Gaylord et al. | 169/23 X |
| 4,388,616 | 6/1983 | Machida | 169/61 X |
| 4,428,434 | 1/1984 | Gelaude | 169/13 |
| 4,583,597 | 4/1986 | Spector et al. | 169/61 |

OTHER PUBLICATIONS

Centrales de Detecciony Serialización de Incendios by Seguridad Electronica, 1981, No. 105.

*Primary Examiner*—William M. Shoop, Jr.
*Assistant Examiner*—Shik Luen Paul Ip
*Attorney, Agent, or Firm*—Harness, Dickey & Pierce

[57] ABSTRACT

A fire prevention system useful for controlling actuation of equipment such as combustion or heating devices used in food preparation. The system according to this invention includes a fire alarm circuit and a timer circuit which automatically shuts down energy supplies to such equipment either in response to the detection of a fire, or during preselected periods of scheduled inoperation of the equipment. The system, therefore, in addition to operating as a fire alarm, reduces the likelihood that a fire will be started when equipment is unattended. The fire prevention system according to this invention further includes a manually operated override circuit which restores energy supplies to the controlled equipment irrespective of the control signals provided by the fire alarm circuit and timer.

11 Claims, 2 Drawing Figures

AUTOMATIC FIRE PREVENTION SYSTEM

BACKGROUND OF THE INVENTION

This invention relates to a fire prevention system, and particularly, to an electronic circuit which automatically shuts down electrical power and fuel supplies to equipment either during periods of non-use to lessen the risk of development of an accidental fire, or in response to the detection of a fire.

Accidental fires often cause significant monetary loss and severe personal injury and death. Fires sometimes originate in food preparation areas of hotels, restaurants, bakeries, ships, trains, etc. where gas and/or electrically powered equipment such as ovens and stoves are used. Malfunctions or improper use of such equipment can lead to a fire which would spread quickly if combustible fuel supply lines rupture or leak in the vicinity of the fire. Most municipalities currently require such food preparation areas to have a fire alarm system. The fire alarm systems typically used have detectors which sense heat or smoke once a fire has started to activate an alarm. Some existing fire alarm systems, when actuated, further communicate to the fire department, activate extinguishing systems, and shut down fuel supplies to equipment. Although such devices operate satisfactorily in detecting the presence of a fire, thereby reducing loss, they do not function in any way to reduce the risk of an accidental fire occurring.

Fires which originate from equipment often start during times of the day when the equipment is unattended. The present invention is related to a fire prevention system which reduces the risk that an accidental fire will occur by automatically shutting off electrical power and fuel supplies to equipment such as those used in food preparation during periods of scheduled non-use. The chances of an accidental fire being started are reduced when such power and fuel supplies are interrupted. The fire prevention system in accordance with this invention is efficiently incorporated into a fire alarm system which operates in a conventional manner.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
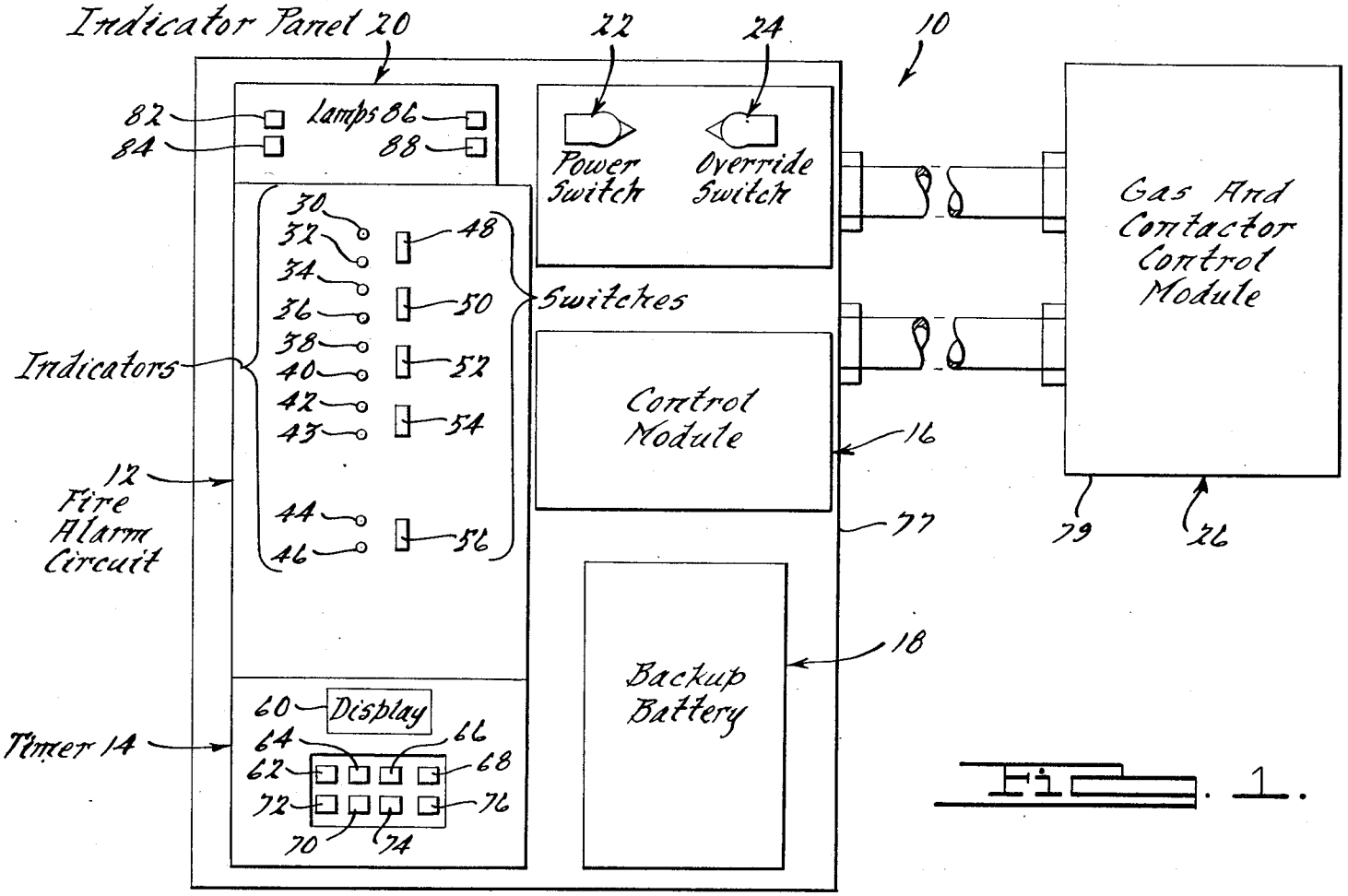
FIG. 1 is a pictorial view of a fire prevention system in accordance with this invention with the various functional subcomponents of the system identified.

A fire prevention system in accordance with this invention is shown by each of the Figures herein and is generally designated by reference number 10. As shown in FIG. 1, fire prevention system 10 principally comprises fire alarm circuit 12, timer 14, control module 16, backup power supply battery 18, indicator lamp panel 20, key operated switches 22 and 24, and gas and contactor control module 26.

Fire alarm circuit 12 may be of any type which receives external fire sensing inputs from sensors, such as remotely located smoke, heat or gas detectors, and processes these inputs to activate an alarm and/or a number of external circuits such as fire suppression systems, transmitters for communicating with local fire departments, etc. A fire alarm circuit 12 which has been successfully employed by Applicant in connection with this invention is the "Emergency Products Corporation" (EPC) Model 8400/8410 device. The EPC fire alarm circuit 12 includes the following visual indicators as shown in FIG. 1: AC power indicator 30 which indicates the presence of input AC power, system alarm indicator 32 which glows when an alarm condition has been detected, system trouble indicator 34 which provides a visual indication that a fault or abnormal operating condition is present, bell trouble indicator 36 which indicates that the audible alarm system has malfunctioned, transmitter indicator 38 which glows when a transmitter circuit has been activated to communicate with a fire department, supervisory indicator 40 which is activated when an abnormal condition exists with an extinguishing system, battery trouble indicator 42 which indicates low external backup power supply voltage, ground fault indicator 43, zone alarm indicator 44 which glows when a fire is detected in a given zone, and zone trouble indicator 46 which lights when the zone has a fault or abnormal operating condition. In addition to the above-mentioned indicators, the EPC fire alarm circuit 12 includes a number of control switches including: system reset switch 48 which resets the system when an alarm condition has been cleared, trouble silence switch 50 which silences an audible trouble signal which is activated with system trouble indicator 34, transmitted disconnect switch 52 for preventing operation of the automatic fire department notification system, system test switch 54 which is used to test all alarm circuitry and controls by simulating the detection of fire, and finally, zone disable switch 56 which disables a particular zone for maintenance purposes. The previously mentioned EPC fire alarm circuit 12 includes each of the above-described indicators, switches and functions and the device or its equivalent is preferably purchased and used in conjunction with this invention as disclosed hereinafter.

Fire protection system 10 according to this invention includes timer 14 which is preferably of the type which may be programmed to provide switching signals at desired times during a seven-day program cycle. The inventors have found the "TORK D-100" digital time control to be an acceptable device for use in conjunction with this invention. The TORK timer 14 is fully programmable to provide a switching signal at designated times during a weekly programmed switching schedule. Timer 14 includes an alphanumerical visual display 60 which displays the present time of the day and operates as an indicator for use in programming the timer. Timer 14 further includes the following control switches: timer buttons 62, 64 and 66 which are used to set the day, hours and minutes, respectively, when entering a timing schedule into timer 14 or when setting the timer to the present time; override button 68 which enables an operator to manually change the system status from preprogrammed input to change its output from "off" to "on" or vice versa; on/off enter button 70 which allows on and off schedules to be entered into memory; clockset button 72 which allows the setting of time for on/off schedules; T1-6 button 74 which allows setting and review of the programmed daily schedules; and set/auto button 76 which allows the timer to provide separate schedules for each day or an automatic schedule for repeating the same daily schedule. As mentioned above, the displays and memory control buttons described above are present in the TORK D-100 series programmable timer. Timer 14 includes its own back-up power source in the form of battery 17.

Backup power supply battery 8 is provided as an auxilary power source for fire alarm circuit 12 in the event of a main supply power interruption. Battery 18 is preferably a nickel cadmium or sealed lead-acid type. The EPC fire alarm circuit 12 also includes circuitry for maintaining battery 18 in a fully charged state.

Control module 16 includes a number of control relays or other switcing devices which are used to provide signals to gas and contactor control module 26. Gas and contactor module 26 provides switching signals for electrical contactors which operate as switches to provide or interrupt power flow to equipment. Module 26 further provides control signals for electrically activated gas or fuel control valves such as solenoid type valves which may be used to interrupt the flow of fuel to equipment. Keyed power switch 22 is provided to enable AC power to the system to be interrupted during diagnostic testing, installation, etc. Keyed override switch 24 enables power and gas supplies to be restored to equipment during diagnostics or failure of the fire prevention system 10. Override switch 24 is preferably of the type which prevents the activation key from being removed when the override function is selected. The continuous presence of the key in such situations provides a reminder that normal operation should be restored. Several indicator lamps are provided on lamp panel 20 to display the status of the overall system including alarm activated lamp 82, override activated lamp 84, and gas valve circuit and contactor circuit status indicator lamps 86 and 88, respectively. The above-described components of fire prevention system 10 are preferably housed in one or more sturdy metal enclosures such as enclosures 77 and 79 which may have a locking access door (not shown).

Figure 2:
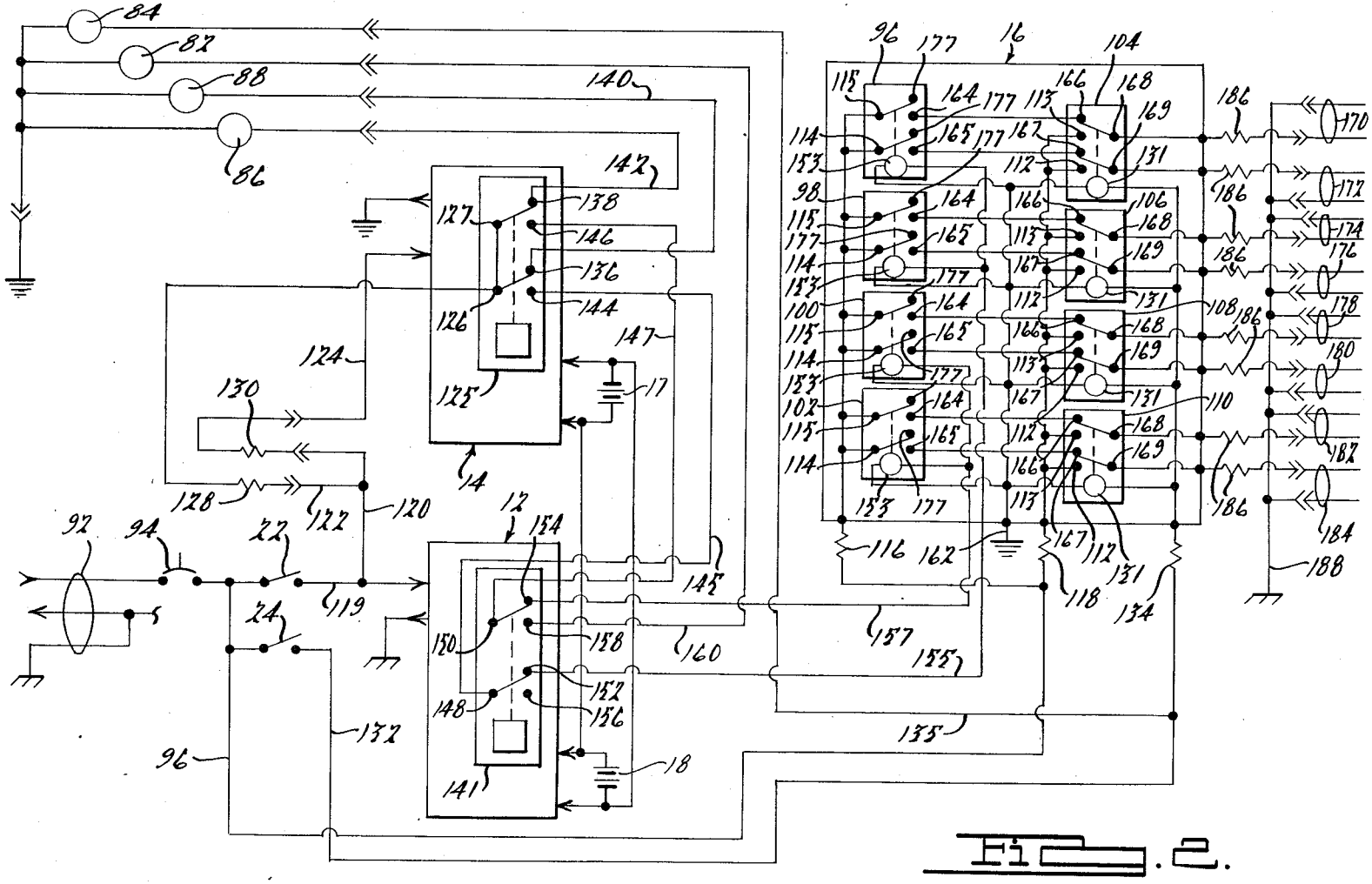
FIG. 2 is an electrical schematic drawing of the fire prevention system in accordance with this invention.

FIG. 2 provides a detailed schematic diagram of the circuit elements of the fire prevention system 10 in accordance with this invention. AC power enters the system through three-wire power supply line 92. Circuit breaker 94 is provided for over-current protection. A pair of branch circuits are provided from the main power supply which are interrupted by keyed power switch 22 and keyed override switch 24. Before power switch 22, line 96 is provided to supply continuous power to control module 16 which includes eight double-pole single-throw relays identified as normal operation relays 96, 98, 100 and 102 and override relays 104, 106, 108 and 110. Each of the relays are shown in FIG. 2 in their normal, non-energized state. Power is provided via line 96 to contacts 112 and 113 of override relays 104 through 110, and to contacts 114 and 115 of normal operation relays 96 through 102. Fuses 116 and 118 are provided for normal operation relays and override relays, respectively. Line 120 is connected to line 119 after power switch 22 and conducts power to fire alarm circuit 12 and is branched into lines 122 and 124. Both lines 122 and 124 are protected by fuses 128 and 130, respectively. Timer 14 provides an output signal by actuating an internal double-pole single-throw relay 125. Alternately, timer 14 could be of a type having solid state type internal switching elements. Power from line 122 is connected to contacts 126 and 127 of relay 125. Line 124 conducts AC power to timer 14. Power is conducted from override switch 24 by line 132 and communicates with relay coils 131 of override relays 104 through 110 which are protected by fuse 134. Line 132 branches to line 135 and is also connected to override activated indicator lamp 84 to indicate that the override function has been selected.

Relay 125 of timer 14 includes contacts 136 and 138. Contact 136 communicates via line 140 to contactor circuit off indicator lamp 88, whereas contact 138 communicates with valve circuit off indicator lamp 86 via line 142. Fire alarm circuit 12, like timer 14, provides an output signal by actuating an internal double-pole single-throw relay 141. Fire alarm circuit 12 also may alternately provide a switching output through the use of solid state elements. Contacts 144 and 146 of timer relay 125 are connected to contacts 148 and 150 of fire protection circuit relay 141 via lines 145 and 147, respectively. Contact 152 of fire alarm circuit relay 141 is connected to the relay cols 153 of normal operation relays 96 and 98 via line 155, whereas contact 154 is connected to relay coils 153 of normal operation relays 100 and 102 via line 157. Contact 156 of fire alarm circuit relay 141 is left open and contact 158 communicates via line 160 to alarm activated indicator lamp 82.

Both fire alarm circuit 12 and timer 14 are provided with auxiliary emergency power by backup power supply batteries 17 and 18. Fire alarm circuit 12 includes a built-in battery charging circuit which maintains battery 18 in a constant state of readiness. Within control module 16, each of the coils 153 and 131 of relay 96 through 110 are tied to ground by line 162. Internally, contacts 164 and 165 of relays 96 through 102 are tied to contacts 166 and 167 of override relays 104 through 110. Contact 168 of relay 104 is connected to external gas valve output 170 and contact 169 is tied to gas valve output 172. Similarly, additional contacts 168 and 169 of override relays 106 are tied to additional gas valve outputs 174 and 176. Contacts 168 and 169 of override relays 108 and 110 are tied to contactor outputs 178, 180, 182 and 184. Outputs 170 through 184 are protected by external fuses 186. Ground return line 188 is provided for gas valve outputs 170 through 176 and gas valve outputs 178 through 184.

Operation of fire protection system 110 will now be explained with reference to the foregoing description. If for any reason AC power is interrupted to fire prevention system 10, for instance, by the failure of the power supply or an opening of circuit breaker 94 or power switch 22, fire alarm circuit 12 senses this absence of power and draws current from backup power supply battery 18. In such instances, system trouble indicator light 34 will glow to indicate that condition.

When AC power is available, power is supplied via line 96 to contacts 114 and 115 of normal operation relays 96 through 102. When power switch 22 is closed, power is also available for fire alarm circuit 12, timer 14, and to contact 126 and 127 of the timer. In the situation where the preprogramming of timer 14 causes the outputs of relay 125 to close between contacts 126, 127, 136 and 138, contactor circuit off 88 and gas valve circuit off lights 86 will glow. Since no power is being conducted to coils 153 of relays 96 through 102, no power is provided to gas valve outputs 170 through 176 and contactor outputs 178 through 184, and therefore, no gas or electrical power is provided for the auxiliary controlled equipment.

Provided that AC power remains available and timer relay 125 provides a power output through contacts 144 and 146, electrical power is made available through lines 145 and 147 to contacts 148 and 150 of relay 141. If fire alarm circuit 12 is not receiving an indication of a fire, relay 141 will switch power to contacts 152 and 154. Lines 155 and 157 connecting to these contacts would then provide power to relay coils 153 of relays 96 through 102, drawing the relays to close to contacts 164 and 165, thereby providing a path for current flow through override relays 104 through 110 and therefore to gas valves outputs and contactor outputs 170 through 184. Therefore, power is available for the externally controlled equipment. If external fire detection devices indicate the presence of a fire, fire alarm circuit 12 will cause the internal alarm relay 141 to connect with contacts 156 and 158, at which point power to normal operation relays 96 through 102 is removed, causing their switching elements to move to their normal position into contact with open contacts 177, therefore terminating power to gas valve and contactor outputs 170 through 184. In this position of alarm relay 141, power is supplied to contact 158 which activates alarm activated indicator lamp 82.

If due to a malfunction of the system or for any other reason it is desired to restore electrical power and fuel supplies to the externally controlled equipment in situations where fire prevention system 10 is interrupting such power, keyed override switch 24 can be activated to provide power via line 132 which is connected to relay coils 131 of override relays 104 through 110. As stated previously, the actuation key for switch 24 preferably cannot be removed in such conditions. Such energization causes these relays to move from their normal position to close against contacts 112 and 113, thereby providing power directly to gas valve and contactor outputs 170 through 84. Simultaneously, override activated indicator lamp 84 glows to indicate this operational status of the system.

As described in the above description of the system and their operation, fire prevention system 10 provides the capabilities of a standard fire alarm control unit by shutting off equipment in response to the detection of a fire. This system further provides an automated mechanism for controlling power and gas supplies to equipment such that power and fuel will be interrupted during normally down period for the equipment, thereby decreasing the likelihood that a fire will originate from such controlled equipment.

While the above description constitutes the preferred embodiments of the present invention, it will be appreciated that the invention is susceptible to modification, variation and change without departing from the proper scope and fair meaning of the accompanying claims.

What is claimed is:

1. A fire prevention system for deactivating equipment in response to the detection of a fire and during preselected time periods, comprising:

a fire alarm circuit providing a first output signal when a fire is detected, and a second output signal when a fire is not detected, a timer circuit providing a third output signal during preselected time periods and a fourth output signal during periods other than said preselected time periods, and at least one switching means which responds to said signals from said fire alarm circuit and said timer circuit for selectively activating and deactivating said equipment; said fire alarm circuit, said timer circuit and said switching means interconnected such that if either said fire alarm circuit provides said first output signal or said timer circuit provides said third output signal, said switching means deactivates said equipment, and said switching means activating said equipment only when both said fire alarm circuit provides said second output signal and said timer circuit provides said fourth output signal.

2. The fire prevention system according to claim 1 wherein said switching means includes means for disconnecting electrical power to said equipment wherein said electrical power is disconnected if either said fire alarm circuit provides said first output signal or said timer circuit provides said third output signal.

3. The fire prevention system according to claim 1 wherein said switching means includes means for disconnecting a source of fuel to said equipment wherein said fuel is disconnected if either said fire alarm circuit provides said first output signal or said timer circuit provides said third output signal.

4. The fire prevention system according to claim 1 further comprising an override switch and override switch circuit means which activates said equipment irrespective of whether the first or second output signal is provided by said fire alarm circuit or whether the third or fourth output signal is provided by said timer circuit.

5. The fire prevention system according to claim 1 wherein said switching means comprises at least one electrical relay, said fire alarm circuit and said timer circuit connected such that an energization coil of said relay is energized when both said fire alarm circuit provides said second output signal and said timer circuit provides said fourth output signal, thereby activating said equipment, and when either said fire alarm circuit provides said first output signal or said timer provides said third output signal, said relay coil is de-energized, thereby deactivating said equipment.

6. The fire prevention system according to claim 5 further comprising an override switch and at least one override relay, said override switch controlling energization of the coil of said override relay such that when said override relay coil is energized, said equipment is activated irrespective of whether the first or second output signal is provided by said timer means or whether its third or fourth output signal is provided by said fire alarm circuit.

7. A fire prevention system for deactivating equipment in response to the detection of a fire and during preselected time periods, comprising:

a fire alarm circuit providing a first output signal when a fire is detected and a second output signal when a fire is not detected, a timer circuit providing a third output signal during preselected time periods and a fourth output signal during periods other than said preselected time periods, at least one normal operation relay, said fire alarm circuit and said timer circuit connected to said normal operation relay such that if either said fire alarm circuit provides said first output signal or said timer circuit provides said third output signal, said normal operation relay deactivates said equipment, and said normal operation relay activating said equipment only when both said fire alarm circuit provides said second output signal and said timer circuit provides said fourth output signal, and at least one override relay for activating said equipment whether said fire alarm circuit provides said first or second output signal or whether said timer circuit provides said third or fourth output signal.

8. The fire prevention system according to claim 7 wherein said switching means includes means for disconnecting electrical power to said equipment wherein said electrical power is disconnected if either said fire alarm circuit provides said first output signal or said timer circuit provides said third output signal.

9. The fire prevention system according to claim 7 wherein said switching means includes means for disconnecting a source of fuel to said equipment wherein said fuel is disconnected if either said fire alarm circuit provides said first output signal or said timer circuit provides said third output signal.

10. The fire prevention system according to claim 7 wherein energization of a coil of said normal operation relay occurs when both said fire alarm circuit provides said second output signal and said timer circuit provides said fourth output signal, thereby activating said equipment, and when either said fire alarm circuit provides said first output signal or said timer provides said third output signal, said normal operation relay coil is de-energized, thereby deactivating said equipment.

11. The fire prevention system according to claim 7 wherein energization of a coil of said override relay causes said equipment to be activated irrespective of whether the first or second output signal is provided by said fire alarm circuit or whether said third or fourth output signal is provided by said timer circuit.

* * * * *